United States Patent [19]

Miller

[11] Patent Number: 4,726,426

[45] Date of Patent: Feb. 23, 1988

[54] FIRE EXTINGUISHMENT SYSTEM FOR AN AIRCRAFT PASSENGER CABIN

[75] Inventor: Ralph G. Miller, Seattle, Wash.

[73] Assignee: The Boeing Company, Seattle, Wash.

[21] Appl. No.: 822,286

[22] Filed: Jan. 24, 1986

[51] Int. Cl.[4] ..... A62C 35/12

[52] U.S. Cl. ..... 169/62; 169/16; 244/118.5; 244/129.2

[58] Field of Search ..... 169/16, 46, 56, 60, 169/61, 62; 244/118.5, 129.2

[56] References Cited

U.S. PATENT DOCUMENTS

| | | | |
|---|---|---|---|
| 2,825,145 | 3/1958 | Scott et al. | 34/43 |
| 3,142,340 | 7/1964 | Jamison | 169/15 |
| 3,303,886 | 2/1967 | Tattersall et al. | 169/16 |
| 3,465,827 | 9/1969 | Levy et al. | 169/2 |
| 3,524,506 | 8/1970 | Weise | 169/2 |
| 3,939,914 | 2/1976 | Carroll | 169/16 |
| 3,952,808 | 4/1976 | Richardson | 169/16 |
| 4,047,571 | 9/1977 | Chaintrier et al. | 169/60 |
| 4,063,595 | 12/1977 | Phillips | 169/60 |
| 4,194,571 | 3/1980 | Monte | 169/61 |
| 4,351,394 | 9/1982 | Enk | 169/16 |

FOREIGN PATENT DOCUMENTS

| | | | |
|---|---|---|---|
| 133839 | 12/1951 | Sweden | 244/129.2 |
| 2032773 | 5/1980 | United Kingdom | 169/16 |

OTHER PUBLICATIONS

*Characteristics of Halon 1301 Dispensing Systems for Aircraft Cabin Fire Protection,* Constantine P. Sarkos, Report No. FAA-RD-75-105, Sep. 1975.

Evaluation of a Halon 1301 System for Postcrash Aircraft Internal Cabin Fire Protection, Richard Hill, Report No. FAA-RD-76-132, Oct. 1976.

*Primary Examiner*—Andres Kashnikow

*Assistant Examiner*—Michael J. Forman

*Attorney, Agent, or Firm*—Bruce A. Kaser

[57] ABSTRACT

In an aircraft (8) having a passenger carrying compartment or passenger cabin (34), an environmental control system, and a cargo fire extinguishment system (36), another fire extinguishment duct is utilized for connecting the fire extinguishment system (36) to the environmental control system. Fire extinguishment is communicated into the environmental control system by the duct and onward into the passenger cabin (34) when a fire is present therein.

2 Claims, 4 Drawing Figures

FIRE EXTINGUISHMENT SYSTEM FOR AN AIRCRAFT PASSENGER CABIN

DESCRIPTION

1. Technical Field

This invention relates to systems for extinguishing fires in enclosures. More particularly, this invention relates to a system for extinguishing a fire in an aircraft's passenger carrying compartment or passenger cabin.

2. Background Art

It is generally known that in some cases portable fire extinguishers have been ineffective in extinguishing accidental fires in the passenger cabin of an aircraft. Mainly, this has been the case when a volatile substance was ignited in the cabin. In this regard, recent Federal Aviation Administration tests, where standard air carrier seats were doused with various volatile substances and then ignited, have shown that hand-held extinguishers using such agents as dry chemicals or carbon dioxide could not extinguish these types of fires. Of recent significance is that many recent hijacker/terrorist threats to commercial aircraft have typically involved the use of volatile fuels inside the passenger cabin.

Small portable fire extinguishers using bromochlorodifluoromethane ($BrClF_2$) have been introduced for use onboard commercial aircraft for upgrading the capability of extinguishing cabin fires. The problem with extinguishers of this type is that they typically are useful only in fighting localized small fires, and as such, they are inadequate against multipoint fires or large surface fires. Ideally, the best way to combat this latter type of fire is to "flood" the environment in the cabin with an effective fire extinguishing substance such as bromotrifluoromethane ($CBrF_3$). Systems employing this concept have been used effectively in engine and cargo compartments of many large commercial aircraft, for example. A common misconception of using such a system in a passenger cabin is the fear that flooding a cabin with a fire extinguishing substance not only may function to extinguish a cabin fire, but it could also cause injury to the passengers in the cabin. Perhaps, for this reason, flooding-type extinguishment systems have not been used in the past.

Recent studies, and referencing two FAA tests entitled "Evaluation of a Halon 1301 System for post-crash aircraft internal cabin fire protection," Report No. FAA-RD-76-132, October 1976; and "Characteristics of Halon 1301 Dispensing Systems for Aircraft Cabin Fire Protection," Report No. FAA-RD-75-105, September 1975; both of which are available to the public through the National Technical Information Service in Springfield, Va., 22151, disclose that bromotrifluoromethane may be used to flood a passenger cabin in sufficient quantities to extinguish a fire while, at the same time, not causing unacceptably high injuries to the passengers. For example, certain studies have shown that humans can tolerate exposures to bromotrifluoromethane of perhaps as high as twenty percent by volume without significant harm. An amount of five percent by volume would be adequate to typically extinguish a cabin fire.

There are many patents in the U.S. patent literature known to be pertinent to the present invention. A list of these patents are as follows:

U.S. Pat. Nos. 2,825,145, issued to Scott et al. on 3/4/58; 3,142,340, issued to W. B. Jamison on 7/28/64; 3,303,886, issued to J. Tattersall et al. on 2/14/67; 3,465,827, issued to M. N. Levy et al. on 9/9/69; 3,524,506, issued to C. A. Weise on 8/18/70; 3,939,914, issued to Carroll on 2/24/76; 4,047,571, issued to Chaintrier et al. on 9/13/77; 4,063,595, issued to Phillips on 12/20/77; and 4,194,580, issued to Monte on 3/25/80.

Of particular pertinence to the present invention is U.S. Pat. No. 3,465,827 issued to Levy et al. Levy teaches a fire protection system that utilizes a foam generating apparatus. The foam generating apparatus introduces a large amount of liquid foam solution into a passenger cabin for the purpose of dousing any cabin fires therein. The foam permits passengers to breathe; however, the teachings of Levy have shortcomings from the standpoint that recent FAA regulations require that passengers have clear visual contact with emergency exits and/or markings or signs showing where emergency exits are located. The problem with utilizing a foam agent is that it obscures passenger vision, which is not a problem with bromotrifluoromethane.

The present invention proposes to use bromotrifluoromethane for extinguishing cabin fires in the matter contemplated in the two above-cited FAA references. These references study the potential use of bromotrifluoromethane in fire situations where an aircraft cabin is flooded with this gas. The invention utilizes the teachings of these references, but uniquely adapts their teachings to already available aircraft hardware without need of complex hardware modification.

DISCLOSURE OF THE INVENTION

The present invention is designed for use in a commercial aircraft of a passenger-carrying type. Typically, such an aircraft has an environmental control system which provides air conditioning or conditioned air into the passenger cabin. The environmental control system is characterized, for example, in that it produces conditioned air from air that is bled from one or more of the aircraft's engines. The conditioned air is communicated by duct work into the passenger cabin. In most commercial aircraft the duct work is located along the length of the cabin in its ceiling.

Most passenger aircraft have relatively large cargo carrying compartments or holds. In all airplanes having class "C" (large cargo hold) holds, it is an FAA requirement that such holds have an onboard fire protection system. One of the most common of such systems is the HALON 1301 fire extinguishment system. HALON 1301 is a trademark of the Du Pont Company for a type of bromotrifluoromethane fire extinguishment agent. The HALON system utilizes a total flooding concept wherein if a fire is present in a cargo hold either forward or aft portions of the hold can be flooded with bromotrifluoromethane.

The present invention provides a means of connecting a flooding type system in an aircraft's cargo hold to the duct work of the environmental control system. This permits communication of bromotrifluoromethane into the passenger cabin in the event of a fire therein.

BRIEF DESCRIPTION OF THE DRAWINGS

Referring now to the drawings, wherein like reference numerals and letters refer to like parts throughout the various views.

BEST MODE FOR CARRYING OUT THE INVENTION

Figure 1:
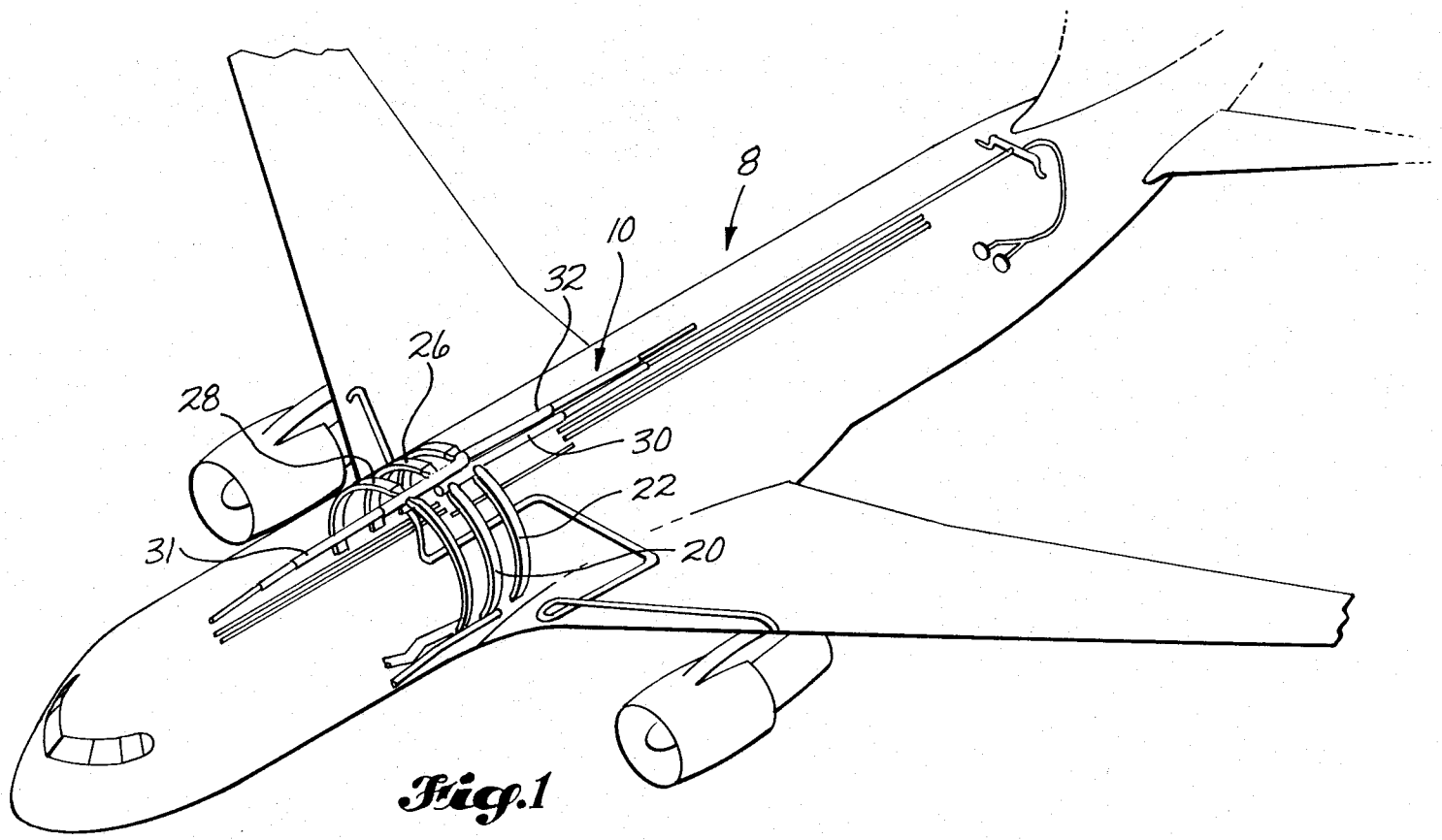
FIG. 1 is a pictorial view of the Environmental Control System (ECS) in a Boeing 767, and shows side wall riser ducts connecting an ECS conditioned air mix manifold to longitudinal ductwork extending along the ceiling of the aircraft's fuselage.

Referring now to the drawings, and first to FIG. 1, therein is shown a typical air conditioning system 10 for a Boeing 767. The system 10 includes an Environmental Control System (ECS) air mix manifold 12 (see FIG. 3) connected to a plurality of ducts 14, 16, which are further connected to a plurality of air conditioning riser ducts 18, 20, 22, 24, 26, 28. The ECS provides conditioned air from air which is bled from the aircraft's engines. This conditioned air is communicated into the ducts 14, 16 and onward to the riser ducts 18, 20, 22, 24, 26, 28. Riser ducts 20 and 22 are connected to a cabin conditioning duct 30 which extends in an aft direction along the inside of the ceiling of the aircraft 8. Likewise, riser ducts 18 and 28 are connected to another cabin conditioning duct 31 which extends forwardly along the ceiling of the aircraft 8, and risers 24, 26 are connected to a central conditioning duct 32. As a person skilled in the art would know, duct 30 primarily provides conditioned air to the aft portion of the passenger cabin 34 depicted in FIG. 3. Ducts 31 and 32 provide, respectively, conditioned air to the forward and central portions of the cabin 34. The air conditioning system 10 as thus described would be quite familiar to a person skilled in the art as this is the typical system utilized aboard every modern commercial aircraft made by The Boeing Company of Seattle, Wash., as well as other aircraft manufacturers.

Figure 3:
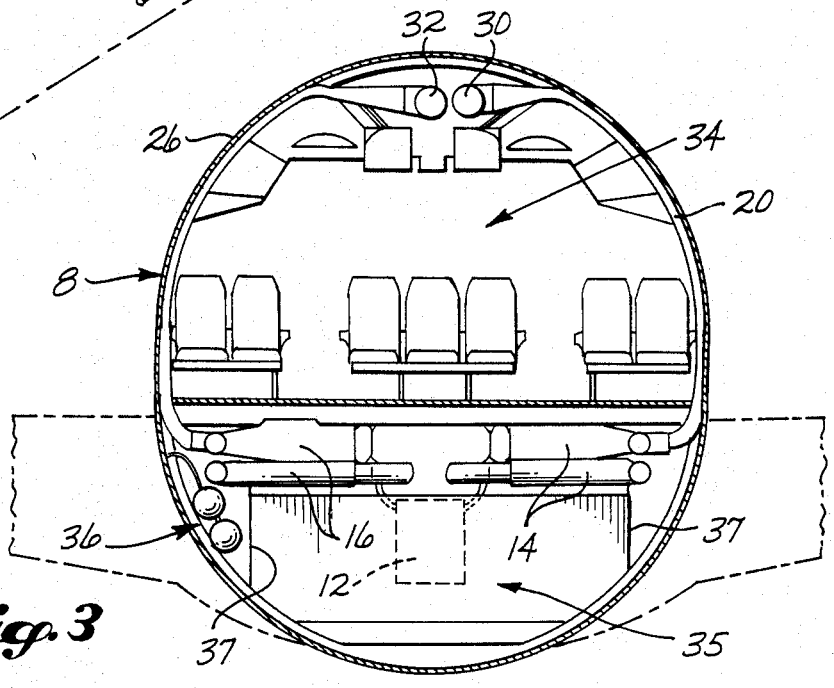
FIG. 3 is a cross-sectional view of the aircraft shown in FIGS. 1 and 2, and is taken from a position looking down the fuselage from the forward end of the aircraft.

Referring now to FIG. 3, located in the lower portion of the aircraft 8 is a cargo compartment 35. The ECS air mix manifold 12 is typically located just aft of this compartment while a HALON 1301 Fire Extinguishment System 36 is located just outside the cargo compartment wall 37.

Figure 4:
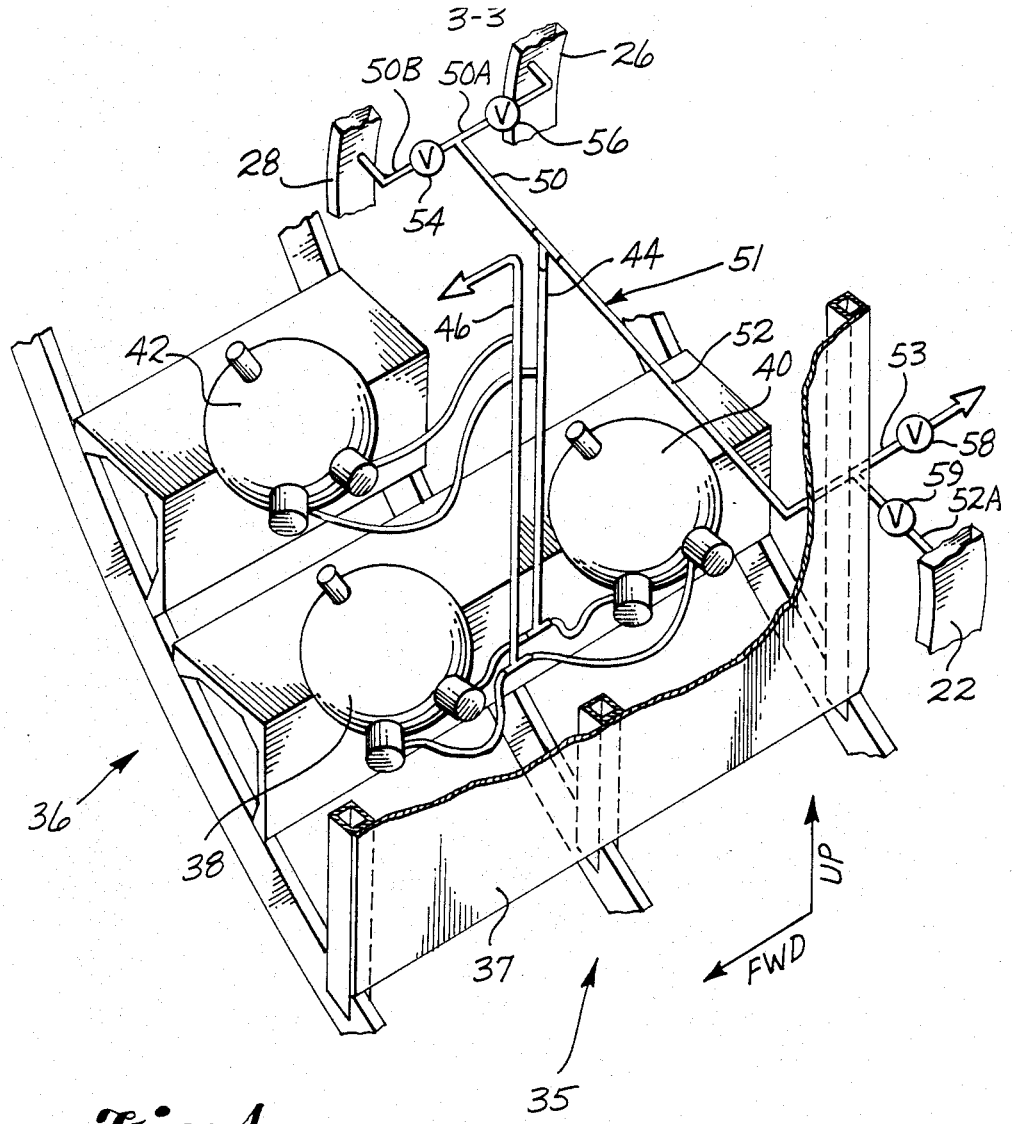
FIG. 4 is an enlarged pictorial view of the cargo compartment fire extinguishment system.

Typically, and referring now to FIG. 4, the system 36 comprises three containers or bottles 38, 40, 42 that contain bromotrifluoromethane extinguishment agent. Two bottles 38, 40 will each contain 55 pounds of the agent compressed into liquid state. The third bottle 42 will contain 33 pounds of the agent. The bottles 38, 40, 42 are connected to first and second high pressure lines (shown schematically at 44, 46 in the drawings) which are controllable for causing bromotrifluoromethane to be communicated either into the cargo compartment 35 when a fire is present therein, or into a fire extinguishment duct 51. With the exception of the connection to duct 51, the HALON 1301 Fire Extinguishment System 36 shown in FIG. 4 as thus described would be familiar to a person skilled in the art. Lines 44, 46 are pre-existing hardware. For example, this system is used onboard most Airbus A300 and 310 aircraft, the McDonald Douglass DC-10, and the Boeing 747, 757, and 767 aircraft.

Figure 2:
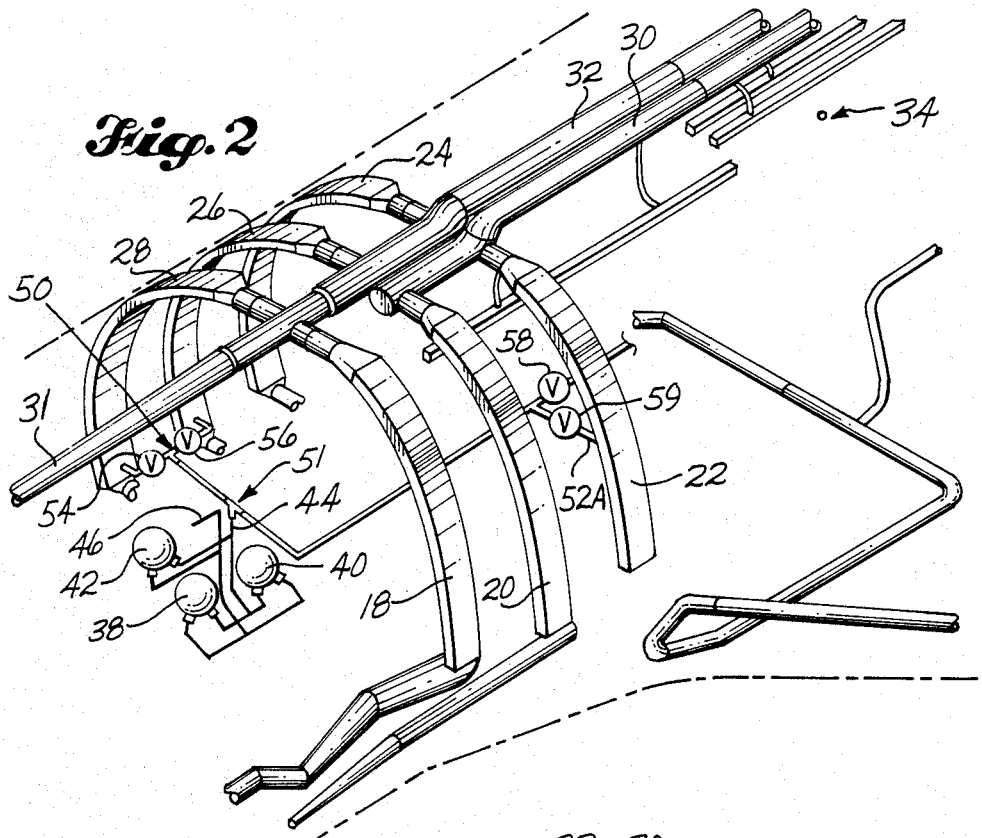
FIG. 2 is an enlarged fragmentary view of FIG. 1 and shows connection of the cargo compartment fire extinguishment system to the riser ducts in accordance with a preferred embodiment of the invention.

Directing attention now to FIG. 2, therein is shown the fire extinguishment duct 51, which is a system of high pressure lines connecting the pre-existing line 44 to the ECS risers. As can be seen in FIG. 4, extending outboard from line 44 are sections 50, 52 of line 51. Section 50 branches into first and second sections 50A, 50B which are connected, respectively, to ECS riser ducts 26, 28. A third section 52A connects the duct 51 to ECS riser duct 22. Still another aft-extending section 53 connects the duct 51 to an area aft of the cargo hold 35. By way of explanation, this aft area could be or is another cargo hold.

Four solenoid valves 54, 56, 58 and 59, positioned in the sections 50A, 50B, 52A, 53, control flow of bromotrifluoromethane agent from the bottles 38, 40, 42 into the ECS risers 22, 26, 28, and into the area aft of the cargo hold 35. If a fire suddenly occurred in the passenger compartment 34, the solenoid valves 54, 56, 59 would be actuated to an open condition, and valve 58 would be closed. This would cause bromotrifluoromethane to be communicated from the bottles 38, 40, 42 into the risers 22, 26, 28. The gas would then flow into the forward, central, and aft extending ceiling ducts 30, 31, 32, and then into the passenger cabin 34.

The valve 58 in the duct 51 is controllable to permit extinguishment to flood the area aft of the cargo compartment, in which the ECS air mix manifold 12 is normally located. Formerly, pre-existing line 44 would be connected to this area.

The solenoid valves 54, 56, 58 may be individually controlled to release extinguishment selectively in either the forward, central, or aft portions of the passenger cabin 34. Further, extinguishment in the cabin 34 is highly controllable by the crew in the aircraft cockpit by managment of the ECS airflow. ECS airflow can be selected or set to meet any particular fire scenerio, i.e., local fires in a particular part of the aircraft cabin or, for example, a flash fire throughout the cabin. Following discharge of extinguishment into the cabin, and upon verification by the crew of successful fire extinguishment, the crew may then configure the ECS into a high vent mode, thereby using the ECS to minimize passenger exposure to either dense smoke or extinguishment.

The embodiment shown and described above is presented herein for exemplary purposes only. It is to be appreciated that the embodiment thus described could be altered substantially without departing from the spirit and scope of the invention. For example, it is conceivable that the ductwork connecting the HALON 1301 system to the ECS riser ductwork could be modified in a number of ways and still accomplish the purpose of the invention. The concept disclosed herein would be equally adaptable to engine Halon bottles which are installed on all modern commercial aircraft for extinguishing potential engine fires. The invention is not to be limited by this description but is to be limited solely by the appended claims which follow, in accordance with the doctrines of patent claim interpretation as established in the patent law.

What is claimed is:

1. In combination, an aircraft having a passenger carrying compartment and an environmental control system for providing conditioned air to said compartment, said environmental control system being characterized in that it includes means for producing conditioned air from engine bleed air, and further includes first, second and third ceiling ducts operable to communicate said conditioned air into said compartment, wherein said first duct is positioned overheadedly in at least a forward portion of said compartment to provide conditioned air thereto, and said second duct is positioned overheadedly in at least a central portion of said compartment to provide conditioned air thereto, and said third duct is positioned overheadedly in at least a rearward portion of said compartment to provide conditioned air thereto, said environmental control system being further characterized in that said environmental control system is operable to selectively provide conditioned air to preselected compartment portions by controlling the flow of conditioned air in said ducts independently each from the other, and operable to control the rate of conditioned air flow from each duct into said duct's respective underlying compartment portion, said aircraft further having a cargo carrying compartment that is separate from said passenger carrying compartment, and a bromotrifluoromethane fire extinguishment system in said cargo compartment, said fire extinguishment system being characterized in that it includes at least one container for holding bromotrifluoromethane, and that it further includes means for communicating said bromotrifluoromethane from said container into said cargo compartment, and further including fire extinguishment duct means interconnecting said fire extinguishment system and said environmental control system, for communicating bromotrifluoromethane from said fire extinguishment system into said first, second and third ceiling ducts, to further communicate said bromotrifluoromethane respectively into said forward, central and rearward portions of said passenger carrying compartment, wherein said fire extinguishment duct means is operable in a manner so as to communicate bromotrifluoromethane into any one of said ducts at any one particular time, and wherein said environmental control system controls the flow of conditioned air in said ducts cooperatively with the flow of bromotrifluoromethane into said ducts, so that the amount of bromotrifluoromethane introduced into said passenger carrying compartment is insufficient to cause human injury.

2. The combination of claim 1, wherein said environmental control system further includes a plurality of riser ducts, with at least one separate riser duct being connected to each of said ceiling ducts, said environmental control system being characterized in that said environmental control system communicates conditioned air into said riser ducts which is further communicated to said ceiling ducts, and wherein said fire extinguishment system includes a plurality of containers, each holding bromotrifluoromethane, and wherein said fire extinguishment duct means includes a duct line connected to said containers in a manner so that bromotrifluoromethane is communicated into said duct line, said duct line having first, second and third conduit sections, one each of said conduit sections being communicatively connected to a separate riser duct, and further including first, second and third solenoid valves, one each of said valves being operatively positioned in, respectively, said first, second, and third conduit sections, for controlling the amount of bromotrifluoromethane which may flow from said containers into said riser ducts.

* * * * *